US007485001B2

(12) United States Patent
Chen et al.

(10) Patent No.: US 7,485,001 B2
(45) Date of Patent: Feb. 3, 2009

(54) GROUNDING TERMINAL FOR ELECTRICAL CONNECTOR

(75) Inventors: Ying-Chung Chen, Taipei Hsien (TW); Chung-Nan Pao, Taipei Hsien (TW)

(73) Assignee: Chief Land Electronic Co., Ltd., Taipei Hsien (TW)

( * ) Notice: Subject to any disclaimer, the term of this patent is extended or adjusted under 35 U.S.C. 154(b) by 0 days.

(21) Appl. No.: 11/952,371

(22) Filed: Dec. 7, 2007

(65) Prior Publication Data

US 2008/0280491 A1 Nov. 13, 2008

(30) Foreign Application Priority Data

May 11, 2007 (TW) ..... 96207714 U

(51) Int. Cl.
*H01R 13/648* (2006.01)

(52) U.S. Cl. ..... 439/608

(58) Field of Classification Search ..... 439/608
See application file for complete search history.

(56) References Cited

U.S. PATENT DOCUMENTS 6,592,381 B2 * 7/2003 Cohen et al. ..... 439/80

FOREIGN PATENT DOCUMENTS

TW 0307240 3/2007

* cited by examiner

*Primary Examiner*—Truc T Nguyen
(74) *Attorney, Agent, or Firm*—WPAT, P.C.; Anthony King

(57) ABSTRACT

A grounding terminal for electrical connector, which can reduce noise, includes a main body, a wing portion and a coupling portion. A connector insulator includes signal terminal openings and L-shaped or U-shaped grounding terminal openings. The wing portion and the coupling portion are extended from both lower side edges of the main body, respectively. Thus, the grounding terminal can be engaged with the L-shaped or U-shaped grounding terminal opening. Although the grounding terminal is not in U shape, the grounding terminal and the grounding terminal opening surround the signal terminals. Therefore, the grounding terminal still provides an EMI shielding similar to that of a conventional U-shaped grounding terminal.

1 Claim, 9 Drawing Sheets

GROUNDING TERMINAL FOR ELECTRICAL CONNECTOR

BACKGROUND OF THE INVENTION

1. Field of the Invention

The present invention relates to a grounding terminal for an electrical connector, and in particular to a grounding terminal that provides electromagnetic interference shielding.

2. The Prior Arts

Electromagnetic compatibility (EMC) comprises two different kinds of issues, electromagnetic interference (EMI) and electromagnetic susceptibility (EMS). EMI is related to the electromagnetic noise produced by an electrical device that interfere other system. EMC is related to correct operation of electrical equipment in the presence of unplanned electromagnetic disturbances.

A conventional electrical connector uses metal grounding piece and grounding terminals to prevent the EMI. Moreover, configurations of the electrical connector also affect the EMI shielding effect.

Referring to FIGS. 1A and 1B, a conventional connector includes a male conductor 14 and a female conductor. The female connector includes a connector insulator 10 and a plurality of terminal modules 12 inserted into the connector insulator 10. The connector insulator 10 has a plurality of L-shaped grounding terminal openings 10*a* and signal terminal openings 10*b* adjacent to the L-shaped grounding terminal openings 10*a*. The male connector 14 includes a plurality of L-shaped grounding terminal 14*a* corresponding to the grounding terminal openings 10*a* and a plurality of post-shaped signal terminals 14*b* corresponding to the signal terminal openings 10*b*. When the male connector 14 is engaged with the female connector, the grounding terminals 14*a* and the signal terminals 14*b* are inserted into the grounding terminal openings 10*a* and the signal terminal openings 10*b*, respectively. Therefore, the grounding terminals 14*a* and the signal terminals 14*b* are electrically connected with the grounding pins (not shown in figures) and the signal pins (not shown in figures) of the terminal modules 12, respectively. The grounding terminals 14*a* are connected with each other in series.

However, after testing, it shows part of electromagnetic interference was not transmitted from the L-shaped grounding terminals 14*a* to the grounding ends 12*a* via the terminal modules 12. The connector insulator 10 has zones 16 affected by electromagnetic interference as shown in FIG. 1B.

In order to solve this problem, Taiwanese Patent No. M307240, Connector Insulator having U-shaped Terminal Opening, discloses a U-shaped grounding terminal opening and a corresponding grounding terminal of a male connector to further surround signal terminals than the L-shaped design does. Thus, the connector offers a better EMI shielding. However, a non U-shaped terminal can be engaged with the U-shaped terminal.

SUMMARY OF THE INVENTION

A primary objective of the present invention is to provide a grounding terminal for an electrical connector which provides EMI shielding. Another objective of the present invention is to provide a grounding terminal which can be engaged with an L-shaped or U-shaped grounding terminal opening. In order to achieve the objectives, a grounding terminal according to the present invention includes a main body, a coupling portion and a wing portion. The coupling portion and the wing portion are extended from both lower side edges of the main body, respectively. The configuration of the grounding terminal allows the grounding terminal to be engaged with an L-shaped or U-shaped grounding terminal opening.

A connector insulator, which is engaged with the grounding terminals according to the present invention, includes grounding terminal openings and signal terminal openings. A plurality of terminal modules is inserted into a side of the connector insulator. The grounding terminal openings are U-shaped or L-shaped. Each grounding terminal opening surrounds a pair of the signal terminals, thereby providing an EMI shielding. A signal pin of the terminal module is electrically connected with the signal terminal inserted into the signal terminal opening. A grounding pin of the terminal module is electrically connected with the grounding terminal inserted into the grounding terminal opening. The main body, the coupling portion and the wing portion are electrically connected with the grounding pin when the grounding terminal is engaged with the terminal module. Therefore, although the grounding terminal according to the present invention is not in U shape, the electrically connected main body, coupling portion and wing portion provides an EMI shielding similar to that provided by a U-shaped grounding terminal.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1A:
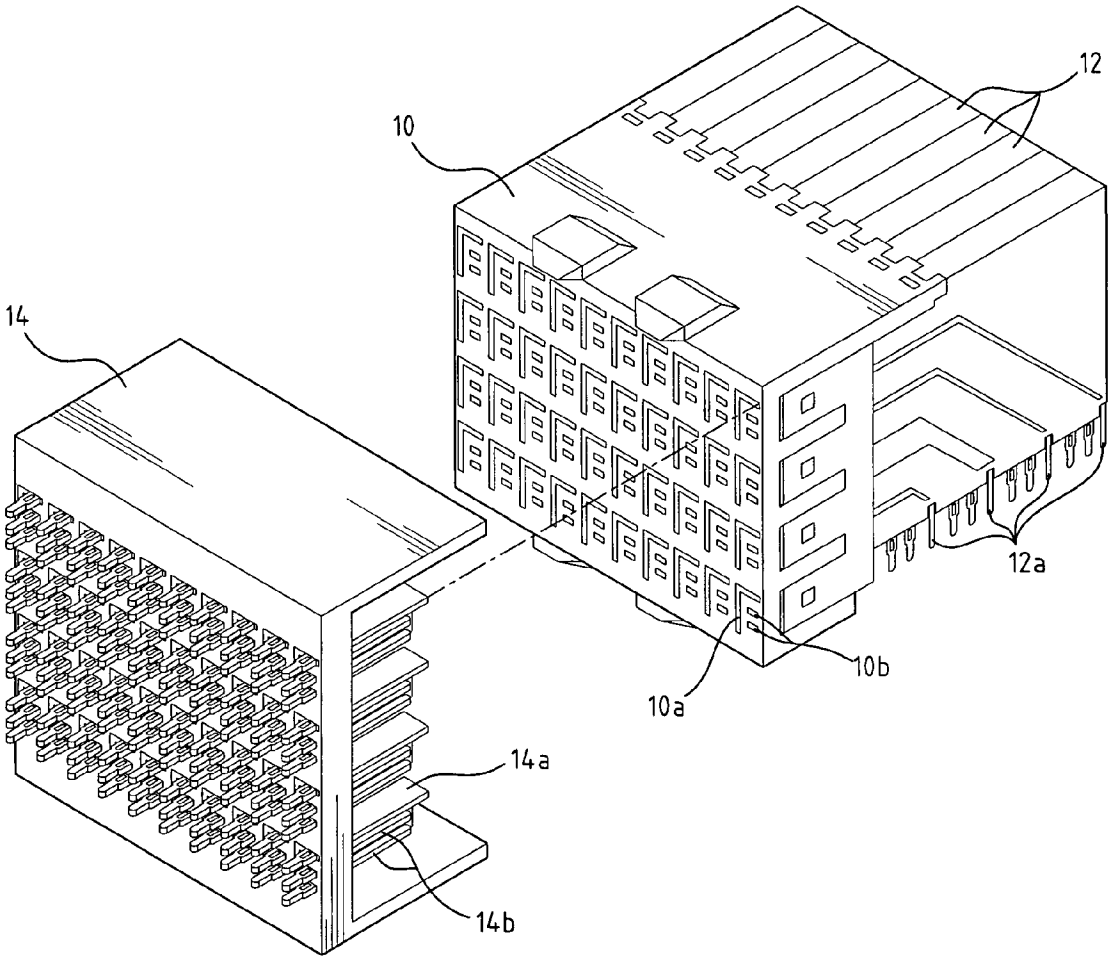
FIG. 1A ( Prior Art )
FIG. 1A is a perspective view showing a conventional electrical connector having L-shaped grounding terminals.
Figure 1B:
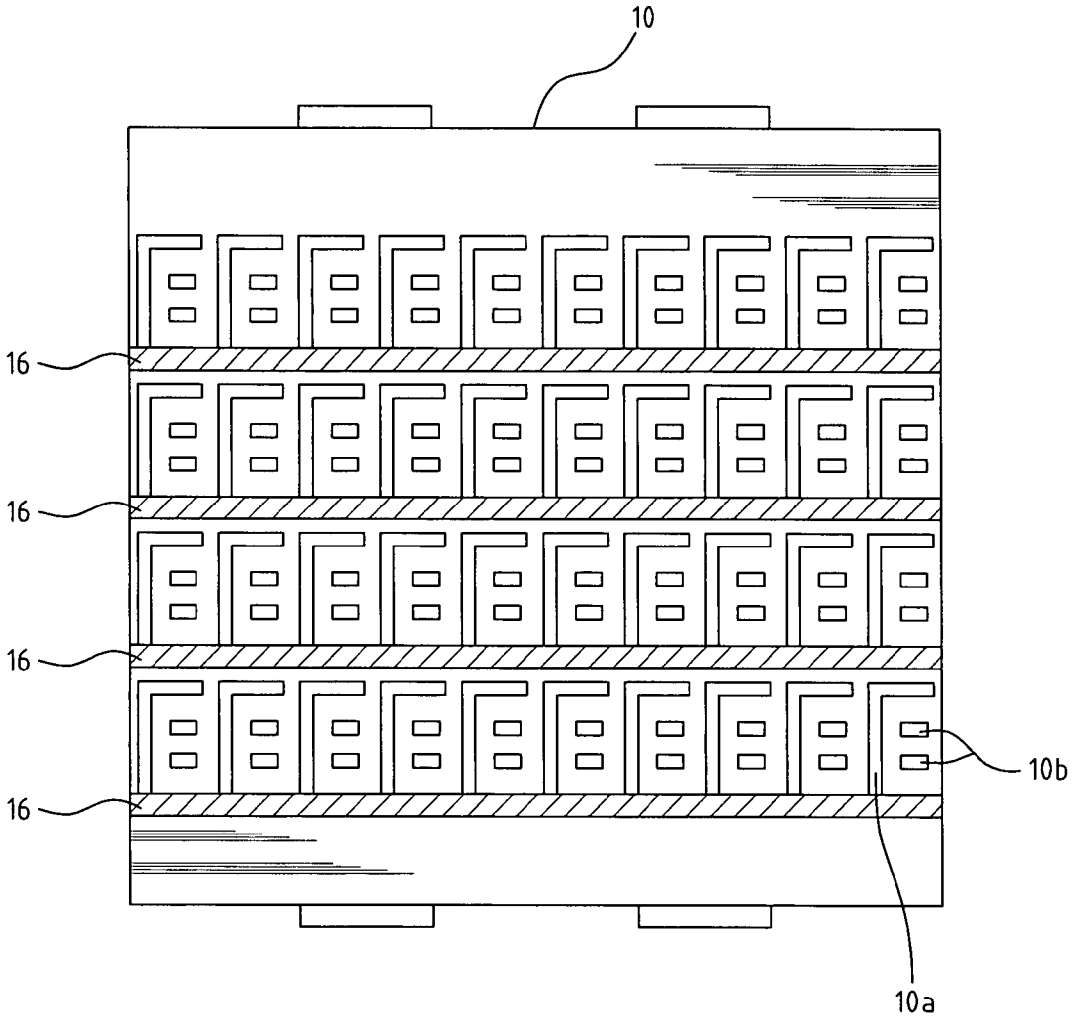
FIG. 1B ( Prior Art )
FIG. 1B is a schematic view showing areas on the conventional electrical connector affected by electromagnetic interference.
Figure 2A:
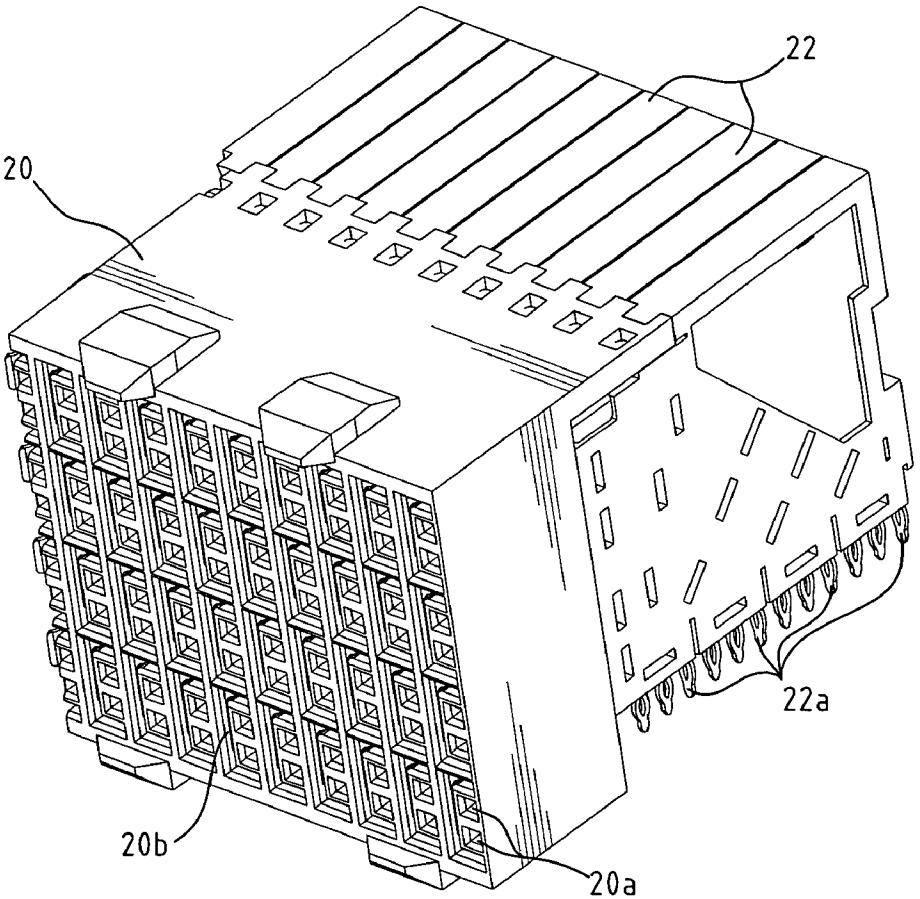
FIG. 2A is an assembly view showing a connector having grounding terminals according to the present invention.
Figure 2B:
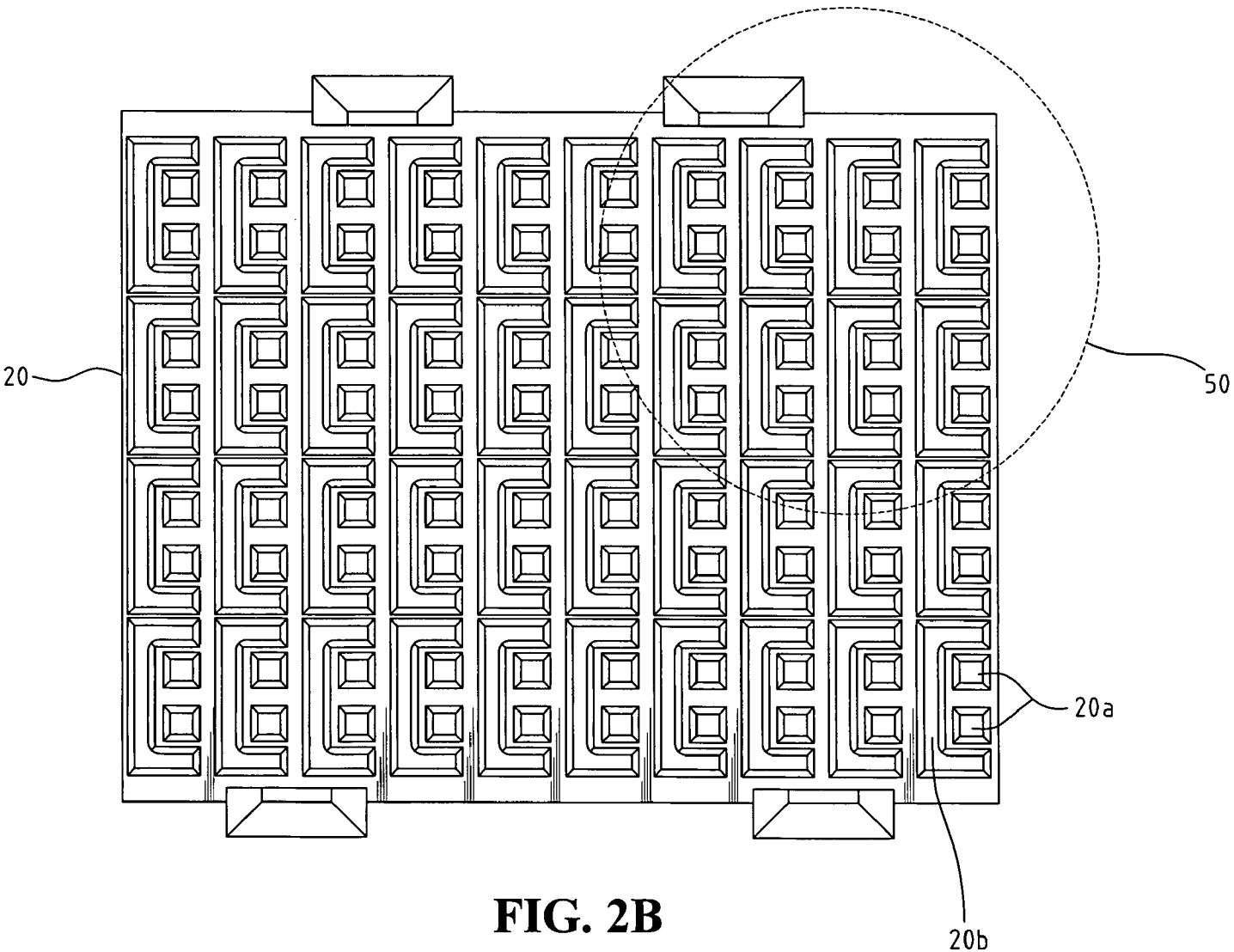
FIG. 2B is a schematic view showing U-shaped grounding terminal openings and signal terminal openings.
Figure 2C:
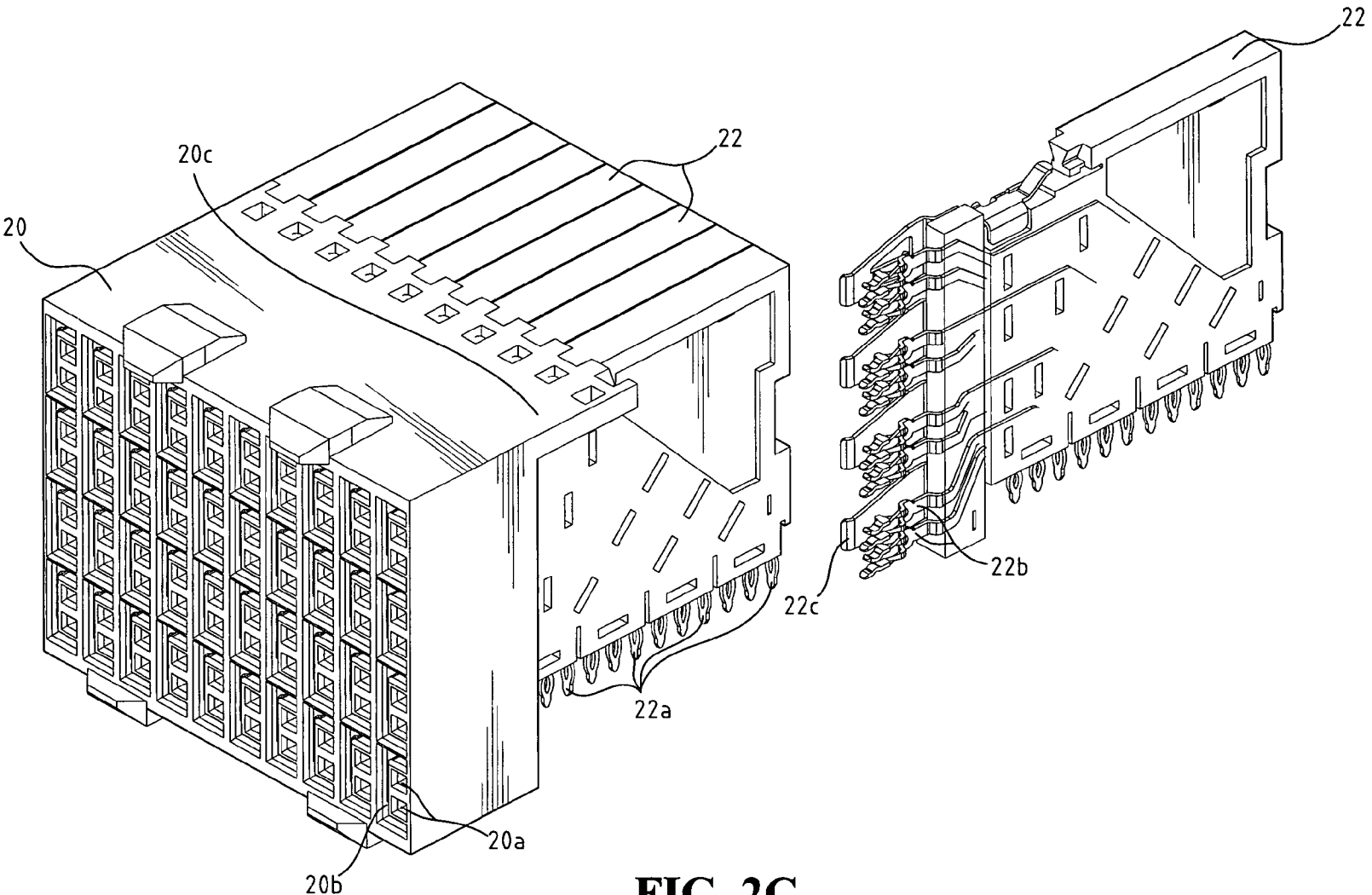
FIG. 2C is a partial exploded view showing the connector and terminal modules.
Figure 3:
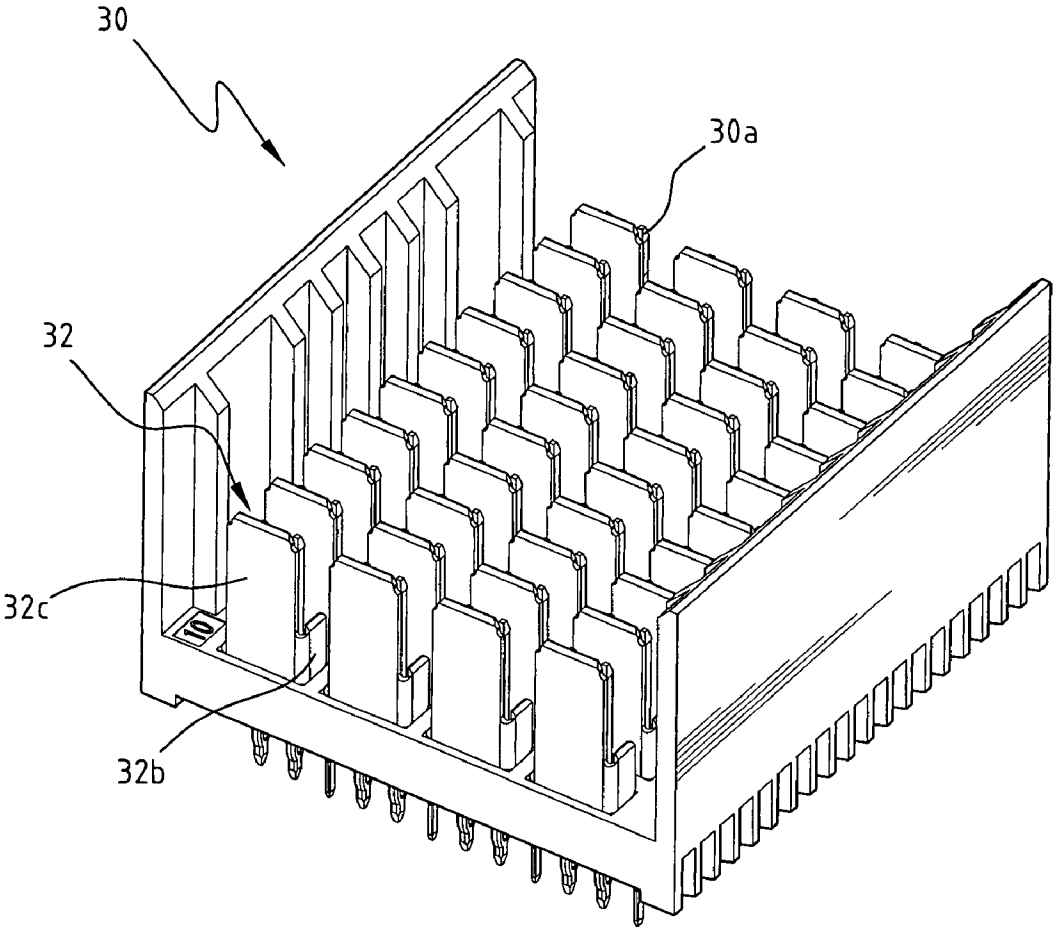
FIG. 3 is a perspective view showing a male connector having the grounding terminals according to the present invention.

An electrical connector having grounding terminals according to the present invention, which can reduce noise, includes a male connector 30 (as shown in FIG. 3) and a female connector (as shown in FIGS. 2A, 2B and 2C).

Referring to FIGS. 2A-2*c*, the female connector includes a connector insulator 20 and a plurality of terminal modules 22 inserted into a side of the connector insulator 20. The connector insulator 20 has a plurality of signal terminal openings 20*a* and U-shaped grounding terminal openings 20*b*.

Referring to FIG. 2B, the signal terminal opening 20*a* is rectangular. Each of the U-shaped grounding terminal opening 20*b* surrounds a pair of the signal terminal openings 20*a*. Referring to FIG. 2C, the terminal module 22 includes a plurality of metal grounding ends 22*a*, fork-shaped signal pins 22*b* and grounding pins 22*c*. The signal pins 22*b* and the grounding pins 22*c* are corresponding to the signal terminal openings 20*a* and the grounding terminal openings 20*b*, respectively.

Referring to FIG. 3, the male connector 30 includes a plurality of post-shaped signal terminals 30*a* and grounding terminals 32 according to the present invention. The signal terminals 30*a* and grounding terminals 32 are corresponding to the signal terminal openings 20*a* and the grounding terminals 20*b*, respectively. Each grounding terminal 32 surrounds a pair of the signal terminals 30*a*.

Figure 5A:
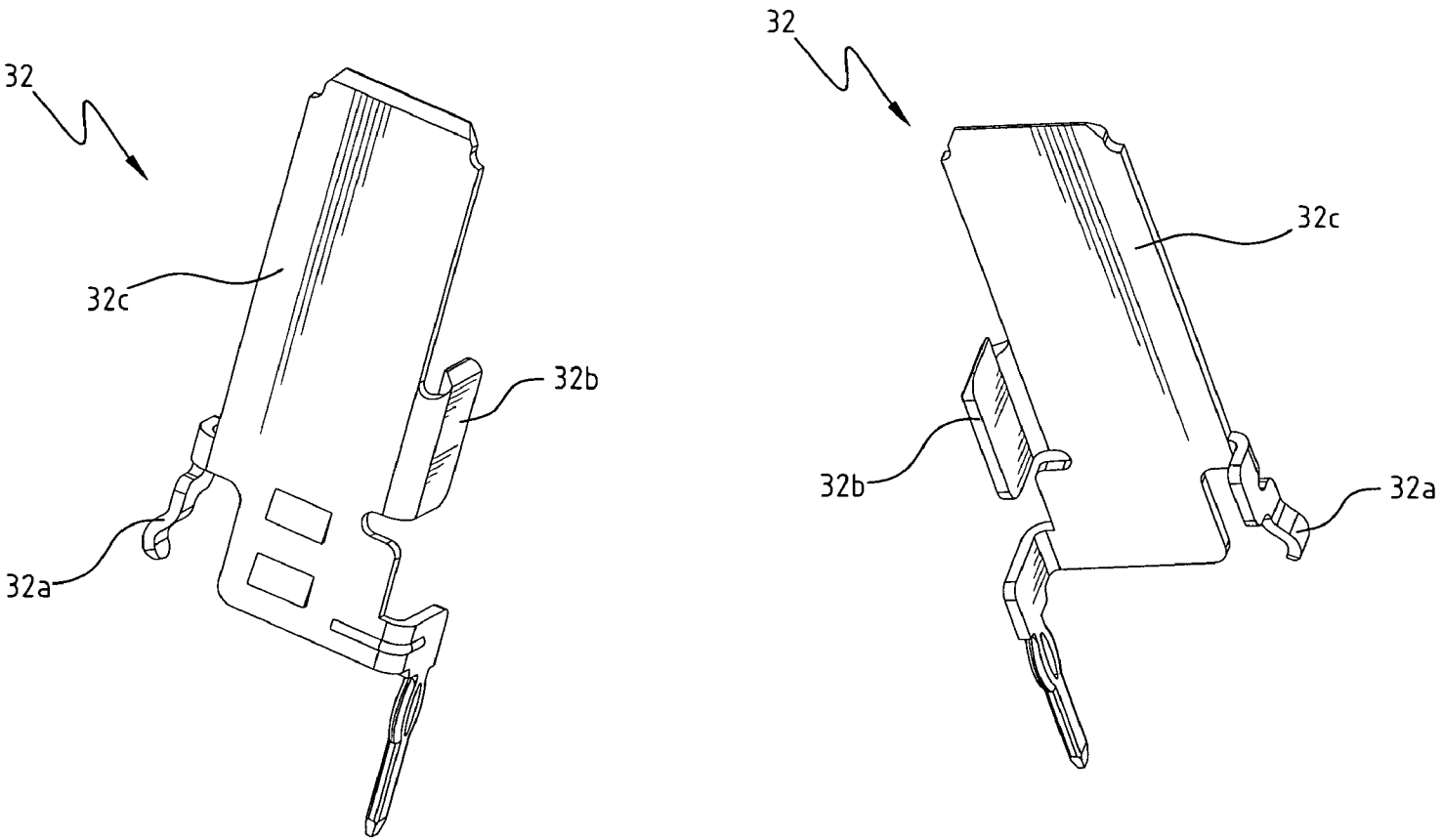
FIG. 5A are perspective views showing the grounding terminal according to the present invention in different viewing angles.
Figure 5B:
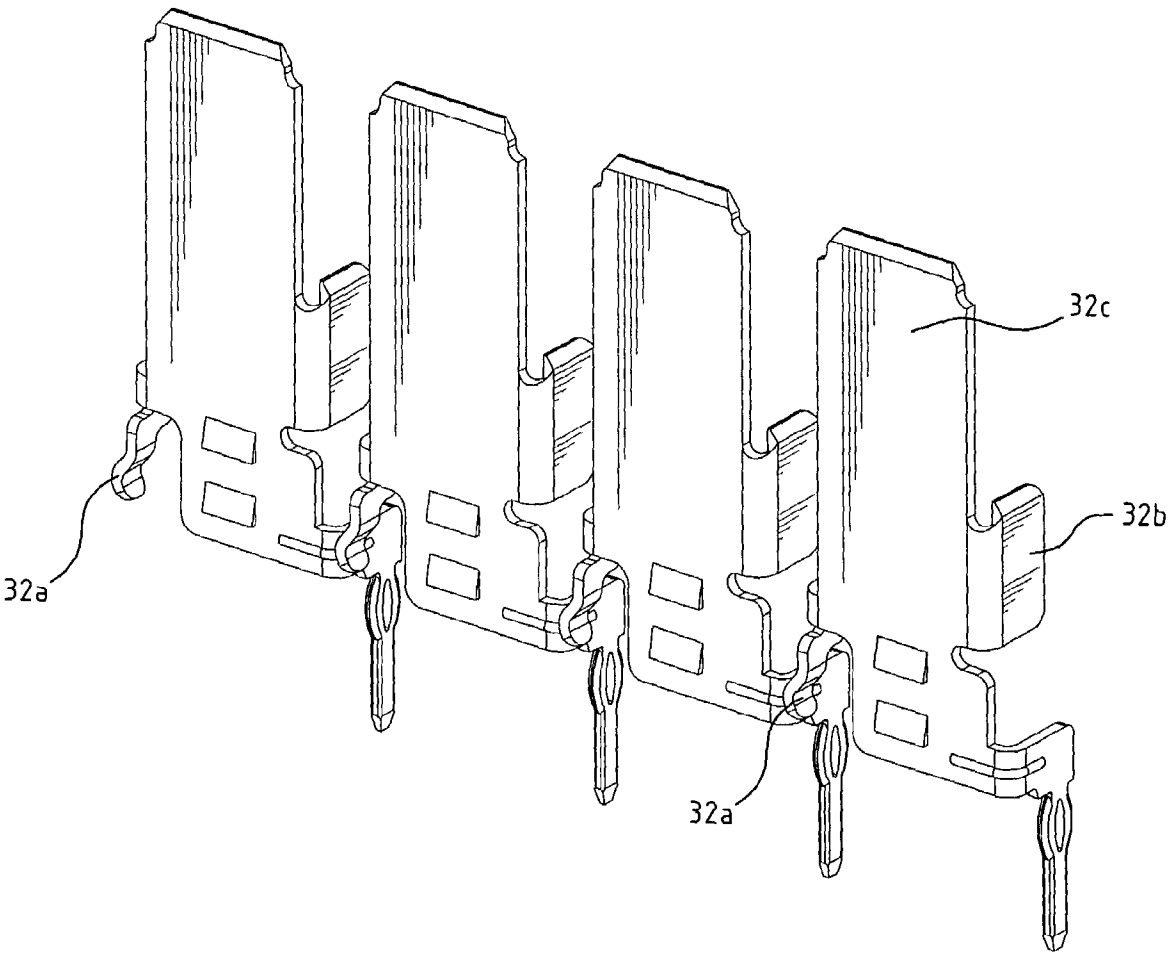
FIG. 5B is a perspective views showing the grounding terminals according to the present invention connected in series.

Referring to FIG. 5A, the grounding terminal 32 according to the present invention includes a main body 32*c*, and a coupling portion 32*a* and a wing portion 32*b* respectively extended from both lower side edges of the main body 32*c*. The coupling portion 32*a* and the wing portion 32*b* are extended toward opposite directions. The wing portion 32*b* is disposed by the main body 32*c* and is shorter than the main body 32*c*. The coupling portion 32*a* is extended away from the main body 32*c*. Referring to FIG. 5B, the coupling portions 32*a* connect the grounding terminals 32 together in series. Thus, when the male connector 30 is engaged with the female connector, the grounding terminals 32 are electrically connected in series. A row of the grounding terminals 32 is integrally formed or assembled from individual terminals.

When the male connector 30 is engaged with the female connector, each of the signal terminals 30*a* and the grounding terminals 32 are inserted into the female connector. When the post-shaped signal terminals 30*a* are inserted into the signal terminal openings 20*a* of the connector insulator 20, the signal terminals 30*a* are electrically connected with the terminal modules 22. More specifically speaking, the signal terminals 30*a* are electrically connected with the fork-shaped signal pins 22*b*. In the similar way, when the grounding terminals 32 are inserted into the female connector, the grounding terminal 32, especially the main body 32*c*, are electrically connected with grounding pins 22*c* of the terminal modules 22. Then, the electromagnetic interference is directed to metal grounding ends 22*a* and removed.

The grounding terminal 32 for noise reduction according to the present invention is engaged with the U-shaped grounding terminal opening 20*b*. Therefore, the grounding terminal 32 surrounds the signal terminals 30*a*, thereby providing interference shielding.

Figure 4:
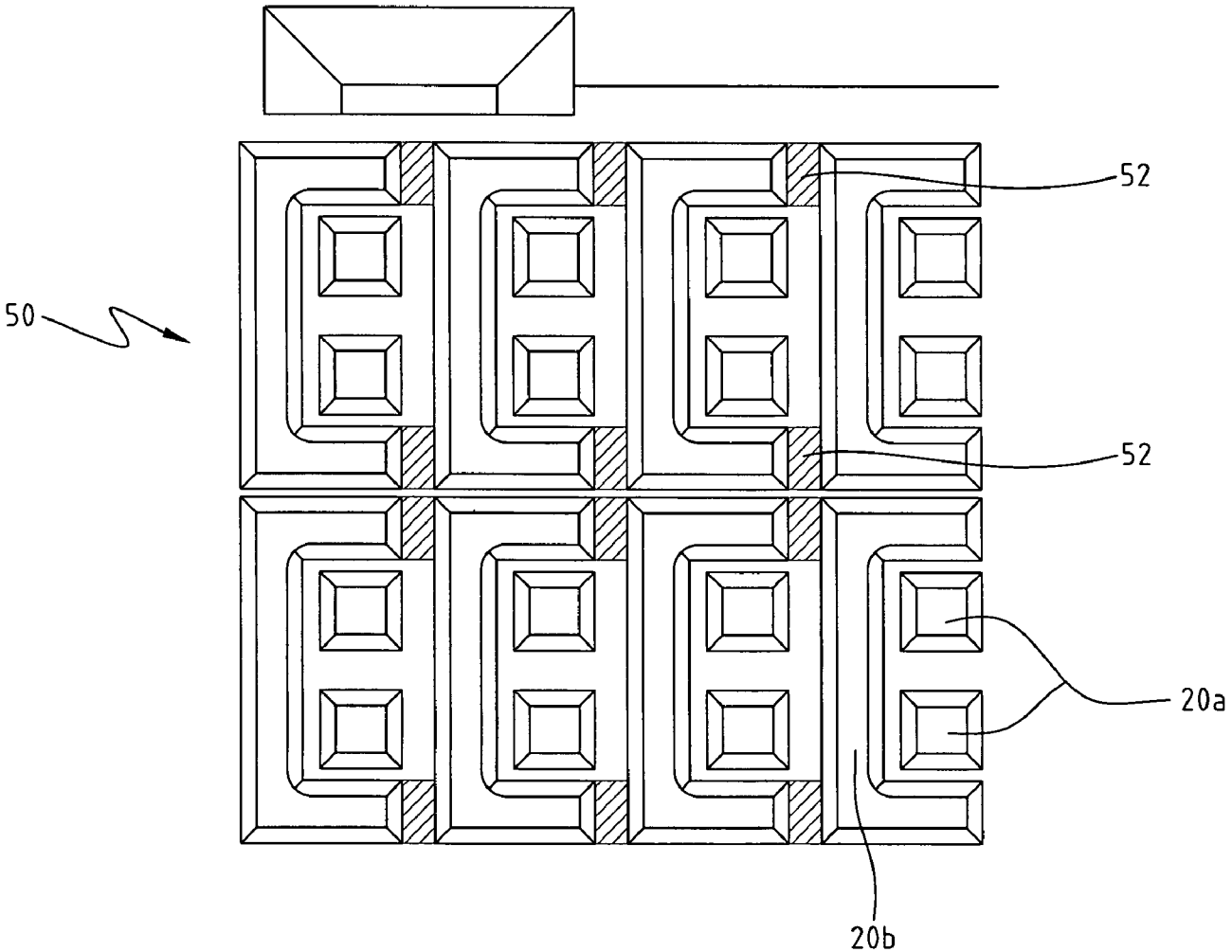
FIG. 4 is a schematic view showing areas on the connector having the grounding terminals according to the present invention affected by electromagnetic interference.

FIG. 4 is a detailed view showing a zone 50 of FIG. 2B. FIG. 4 is a schematic view showing ranges 52 influenced by electromagnetic interference. When the grounding terminal 32 according to the present invention and the corresponding U-shaped grounding terminal opening 20*b* are used, the ranges 52 affected by electromagnetic interference are limited to small areas between the grounding terminals 32.

The grounding terminal 32 according to the present invention can be engaged with a U-shaped or L-shaped grounding terminal opening. When the grounding terminal 32 according to the present invention is inserted into the L-shaped grounding terminal opening 10*a*, only the main body 32*c* and the wing portion 32*b* are inserted into the grounding terminal opening 10*a*. Although the coupling portion 32*a* is outside of the grounding terminal opening 10*a*, the coupling portion 32*a* is electrically connected with the grounding pin 22*c* of the terminal module 22 via the grounding terminal 32. Therefore, the coupling portion 32*a* still provides an improved EMI shielding.

When the grounding terminal 32 according to the present invention is inserted into the U-shaped grounding terminal opening 20*b*, the main body 32*c*, the wing portion 32*b* and the coupling portion 32*a* are inserted into the grounding terminal opening 20*b*. The grounding terminal 32 is inserted further into the U-shaped grounding terminal opening 20*b* than into the L-shaped grounding terminal opening 10*a*. Although the grounding terminal 32 is not in U shape, the grounding terminal 32 is electrically connected with the grounding pin 22*c* of the terminal module 22. Therefore, the grounding terminal 32 provides an EMI shielding similar to that provided by the conventional U-shaped grounding terminal.

Referring to FIG. 2*c*, the connector insulator 20 includes a rail portion 20*c*. The rail portion 20*c* may have a plurality of guiding rails at a bottom thereof (not shown in Figures). The terminal modules 22 can glide along the guiding rails to be inserted into the connector insulator 20.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A first grounding terminal capable of being engaged with a connector insulator having L-shaped or U-shaped grounding terminal openings, a plurality of terminal modules being fitted into the connector insulator, the connector insulator further comprising a plurality of signal terminal openings by the grounding terminal openings, a signal terminal being inserted into the signal terminal opening to be electrically connected with a fork-shaped signal pin of the terminal module, each of the grounding terminal opening surrounding a pair of signal terminal openings, the first grounding terminal comprising:

a piece-shaped main body;

a wing portion extended from a lower first side edge of the main body and disposed by the main body, the wing portion being shorter than the main body;

a coupling portion extended from a lower second side edge of the main body and extended away from the main body;

wherein the main body and the wing portion being inserted into the grounding terminal opening to be electrically connected with a grounding pin of the terminal module;

wherein the coupling portion of the first grounding terminal makes abutting contact to a lower first side of a second liked grounding terminal, and the second liked grounding terminal has a coupling portion that makes abutting contact to a lower first side of a third liked grounding terminal; and wherein the first grounding terminal, the second grounding terminal, and the third grounding terminal are coupled in series.

* * * * *